US011767683B2

(12) United States Patent
Toalson

(10) Patent No.: US 11,767,683 B2
(45) Date of Patent: Sep. 26, 2023

(54) SELF SUPPORTING TILT OVER MAST

(71) Applicant: David Toalson, Bellville, TX (US)

(72) Inventor: David Toalson, Bellville, TX (US)

( * ) Notice: Subject to any disclaimer, the term of this patent is extended or adjusted under 35 U.S.C. 154(b) by 0 days.

(21) Appl. No.: 17/001,366

(22) Filed: Aug. 24, 2020

(65) Prior Publication Data

US 2021/0062532 A1 Mar. 4, 2021

Related U.S. Application Data

(60) Provisional application No. 62/891,849, filed on Aug. 26, 2019.

(51) Int. Cl.
*E04H 12/34* (2006.01)
*E04H 12/18* (2006.01)
*B66D 1/74* (2006.01)

(52) U.S. Cl.
CPC ..... *E04H 12/345* (2013.01); *E04H 12/187* (2013.01); *B66D 1/7489* (2013.01)

(58) Field of Classification Search
CPC .... E04H 12/345; E04H 12/187; B66D 1/7489
USPC ..... 135/20.3
See application file for complete search history.

(56) References Cited

U.S. PATENT DOCUMENTS 2,213,870 A * 9/1940 Scholl ..... E04H 12/187 52/125.2
2,822,066 A * 2/1958 Hanson ..... E04H 12/187 416/142
3,977,139 A * 8/1976 Bryant ..... E04H 12/34 52/697
4,149,347 A * 4/1979 Boemer ..... E04H 12/187 52/116
4,590,719 A * 5/1986 McKibbin ..... E04H 12/34 52/745.18
8,130,168 B1 * 3/2012 Sergi ..... H01Q 1/1242 343/890
9,228,370 B1 * 1/2016 Boniface ..... H02S 10/12
10,781,603 B1 * 9/2020 Darragh ..... E04H 12/187
11,021,888 B1 * 6/2021 Smith ..... E04H 12/345
2002/0023672 A1 * 2/2002 Reese ..... A45B 17/00 135/20.1
2002/0129847 A1 * 9/2002 Ma ..... A45B 23/00 135/21

(Continued)

FOREIGN PATENT DOCUMENTS

CA 2777181 A1 * 11/2012 ..... E04H 12/187
GB 2427626 A * 1/2007 ..... E04H 12/187

(Continued)

*Primary Examiner* — Babajide A Demuren
(74) *Attorney, Agent, or Firm* — Law Office of Jeff Williams PLLC; J. Oliver Williams

(57) ABSTRACT

The system of the present invention is a tilt over mast that is easy to construct from the ground and permits azimuthal adjustments from the ground with the mast elevated to working heights. The system used for calibrating a directional antenna and includes two or more mast sections, namely a base member, a mid member, and a top member. The mid member may be pivotally coupled about the base member at a number of positions. The top member is coupled to an opposing end of the mid member and supports the desired equipment. A method of constructing and operating the system is described.

12 Claims, 9 Drawing Sheets

(56) References Cited

U.S. PATENT DOCUMENTS

| | | | | |
|---|---|---|---|---|
| 2002/0149536 | A1* | 10/2002 | Safakhah | H01Q 1/1242 343/882 |
| 2006/0201542 | A1* | 9/2006 | Ma | A45B 23/00 135/21 |
| 2008/0041431 | A1* | 2/2008 | Tung | A45B 19/00 135/21 |
| 2008/0223422 | A1* | 9/2008 | Lai | A45B 23/00 135/21 |
| 2010/0037929 | A1* | 2/2010 | Liu | A45B 19/04 135/20.3 |
| 2010/0172690 | A1* | 7/2010 | Cash | E04H 12/187 403/119 |
| 2014/0115977 | A1* | 5/2014 | Egan | E04H 12/187 52/111 |
| 2015/0075089 | A1* | 3/2015 | Anderson | H01Q 1/1242 52/745.18 |
| 2015/0308140 | A1* | 10/2015 | Clifton | E02D 27/425 248/346.2 |
| 2016/0060890 | A1* | 3/2016 | Van Wyk | E04H 12/187 52/120 |
| 2016/0305147 | A1* | 10/2016 | Homsi | B66C 1/108 |
| 2019/0150310 | A1* | 5/2019 | Struhsaker | H02S 30/20 361/809 |

FOREIGN PATENT DOCUMENTS

| | | | | |
|---|---|---|---|---|
| GB | 2595298 | A * | 11/2021 | B63B 15/0083 |
| KR | 101497661 | B1 * | 3/2015 | |
| KR | 200481187 | Y1 * | 8/2016 | |
| WO | WO-2017024348 | A1 * | 2/2017 | E04H 12/18 |

* cited by examiner

SELF SUPPORTING TILT OVER MAST

CROSS REFERENCE TO RELATED APPLICATIONS

This application claims the benefit of earlier filing date and right of priority to U.S. Provisional Application No. 62/891,849, filed 26 Aug. 2019, the contents of which is incorporated by reference herein in its entirety.

BACKGROUND OF THE INVENTION

1. Field of the Invention

The present application relates to tilt over masts, and more particularly to directional antenna masts.

2. Description of Related Art

To provide internet and phone communications to rural or remote locations, specialized network infrastructure that is cheap, lightweight, and easy to construct is desired. Some communication networks permit line-of-sight radios and antennas that transmit communications via electromagnetic signals; however, to use this method requires that the antennas be elevated clear of structures, terrain, and trees. There are various solutions to construct a system that supports an elevated antenna. In one approach, a guyed telescoping mast can be employed where the mast is supported by at least three sets of guy wires. However, installation of guy wires requires additional equipment and labor to install. Furthermore, the guy wires present an allision hazard for users (especially for children) and are generally unsightly. Once the guy wires are installed, the mast becomes a semi-permanent structure which makes for difficult antenna maintenance since a worker must climb or de-telescope the mast for servicing. If the mast is de-telescoped, the guy wires must be loosened, managed, and re-tensioned. In another approach, self-supporting truss towers are used. However, a truss tower can be expensive and difficult to construct as it consists of multiple short sections each of which requires a gin pole to install. The truss sections can be costly to produce and require a complex foundation of concrete and rebar to anchor the tower to the ground. Furthermore, a certified worker must climb the tower to assist in erecting the tower, to install the antenna, as well as to service the antenna or connecting cabling for the antenna.

In some instances, the antenna is a directional antenna and therefore requires directional calibration to set up the communication network at the rural location. In this instance, a certified worker would have to climb the mast in order to adjust the direction of the directional antenna which requires additional manpower coordination and safety precautions.

Although strides have been made to improve a mast assembly for a network antenna, some shortcomings remain. It is desired to make a mast assembly that is quick to install, does not require climbing, is inexpensive, require minimum labor and equipment to construct, and permits azimuthal adjustments to a directional antenna from ground level as well as easy antenna maintenance access.

BRIEF SUMMARY OF THE INVENTION

It is an object of the present application to provide a mast assembly that is quick to install, is inexpensive, requires minimum labor and equipment in construct, and permits azimuthal adjustments to a directional antenna from ground level as well as easy antenna maintenance access. The assembly includes a base member having a first end and a second end, the base member secured to the ground at the first end. A mid member is pivotally coupled to a portion of the base member. One or more upper members may be included and selectively coupled to a portion of the mid member at a distal end of the mid member. The mid member is configured to pivot such that the top member is adjacent the ground to facilitate maintenance and adjustment.

It is a further object of the present application that a lifting mechanism may be included to facilitate the pivoting action of the mid member relative to the base member. The lifting mechanism may be mechanical in operation or include electrical components. Additionally, hydraulics may be used.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
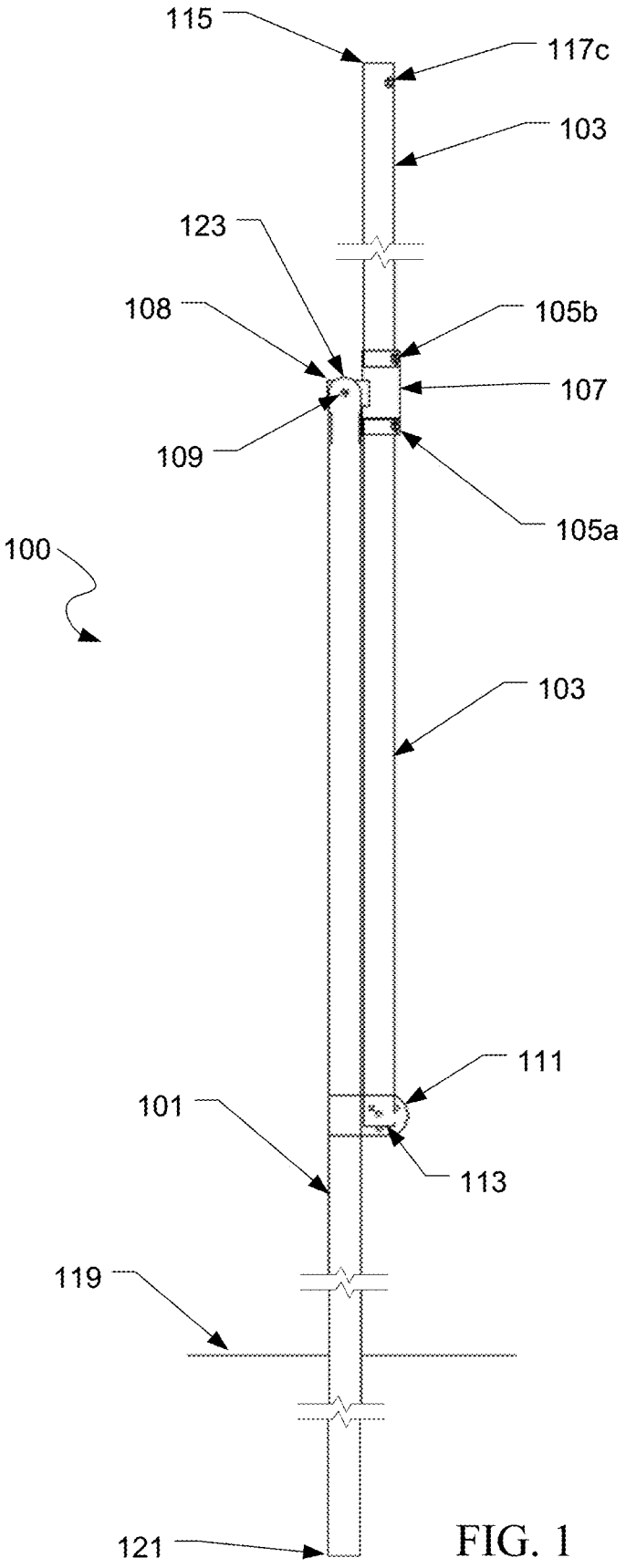
FIG. 1 is a tilt over mast assembly including a base member and a mid member, in accordance with an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

Embodiments of the present invention overcomes one or more of the above-discussed problems commonly associated with conventional antenna masts. In particular, the system of the present invention is a tilt over mast that is easy to construct and permits azimuthal adjustments to the mast for calibrating a directional antenna. The system comprises of three or more mast sections: a base member, a mid member, and a top member. The mid member may be pivotally coupled about the base member at a number of positions. A first position is to pivot the mid member along the length of the base member wherein the pivot point is at a first end of the mid member. A second position is to pivot the mid member at an end of the base member wherein the pivot axis is located at a mid point in the length of the mid member. The top member is coupled to an opposing end of the mid member and supports the desired equipment. Additional details of the assembly are described herein, including the operation of the assembly as a whole.

While the present embodiment shows a three-section mast, it will be obvious to those skilled in the art that more or less sections/members can be employed. In some instances, only two lower sections may be required. Sections may have cross sections that are round, square, or rectangular as required. No particular cross section profile is required but for purposes herein a square profile for the base member and a circular profile for the mid member and the top member will be used to describe the function and features of the assembly. It is understood that any profile helps to define an internal volume.

The system and method will be understood, both as to its structure and operation, from the accompanying drawings, taken in conjunction with the accompanying description. Several embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The system and method of the present application is illustrated in the associated drawings. As used herein, "system" and "assembly" are used interchangeably. It should be noted that the articles "a", "an", and "the", as used in this specification, include plural referents unless the content clearly dictates otherwise.

Figure 2:
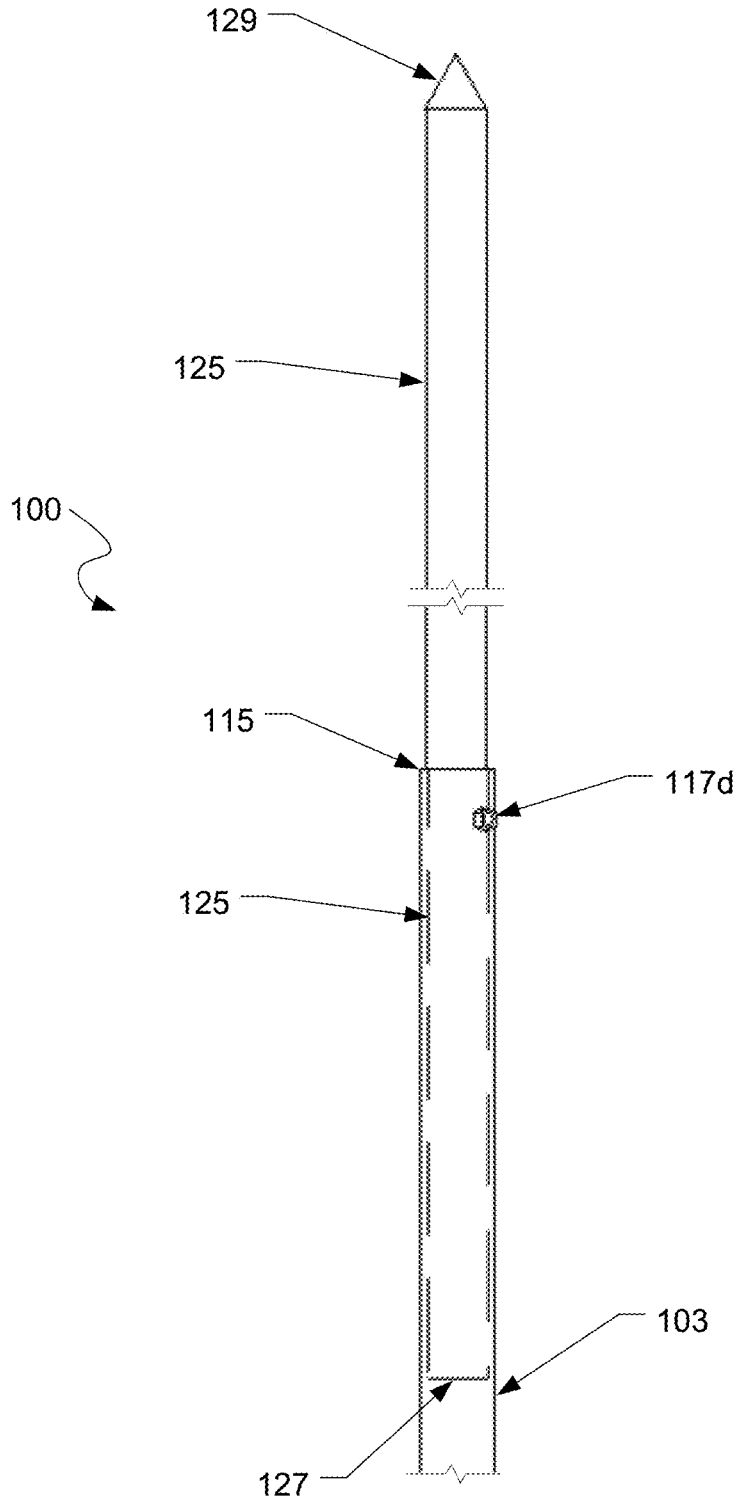
FIG. 2 is the tilt over mast assembly of FIG. 1 illustrating the mid member in communication with a top member.
Figure 10:
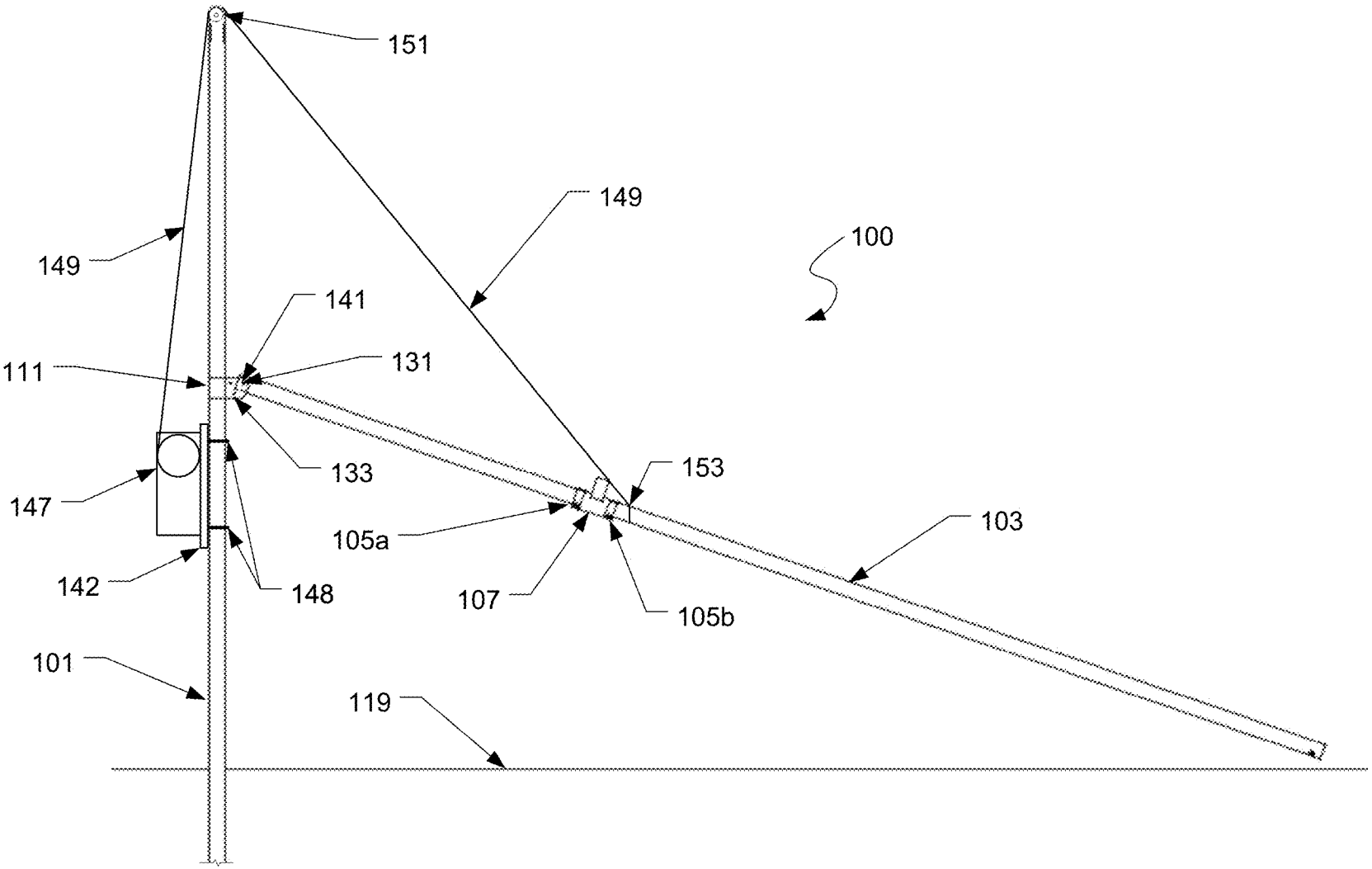
FIG. 10 is a first method of using the tilt over mast assembly of FIG. 1.
Figure 11:
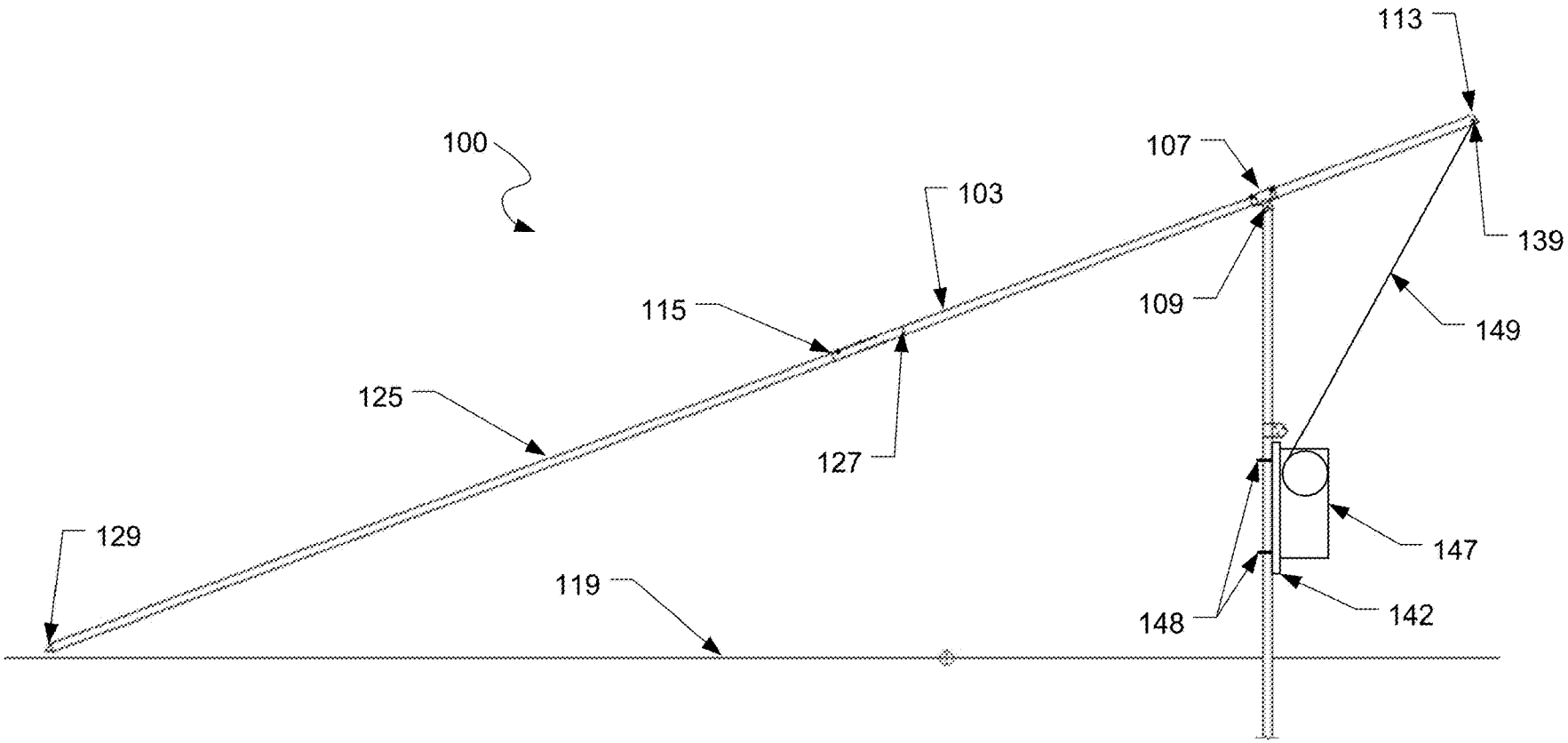
FIG. 11 is a second method of using the tilt over mast assembly of FIG. 1.
Figure 12:
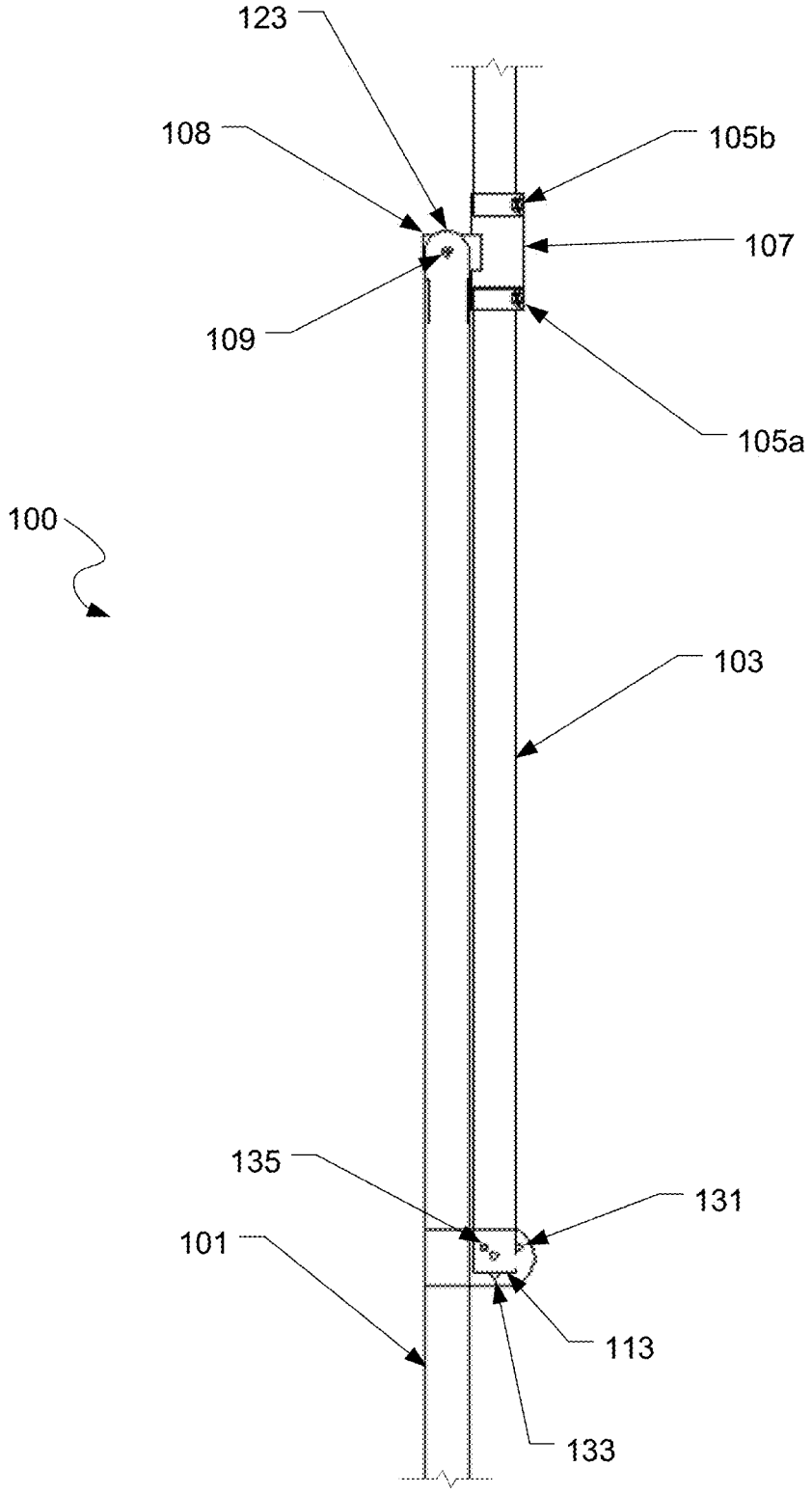
FIG. 12 is a third method of using the tilt over mast assembly of FIG. 1.

Referring now to the drawings wherein like reference characters identify corresponding or similar elements in form and function through the several views. FIGS. 1 and 2 illustrate assorted views of components of a tilt over mast assembly 100. FIGS. 3-9 illustrate components used within the tilt over mast assembly 100 to facilitate its function. FIGS. 10-12 illustrate various exemplary methods of operation for assembly 100.

Referring now to FIG. 1 in the drawings, tilt over mast assembly 100 is illustrated. Assembly 100 includes a plurality of sections or members. As shown in the Figures, three members will be used to describe the invention. A base member is secured to the ground, a mid member 103 is pivotally coupled to the base member 101, and a top member is coupled to a distal end of the mid member 103 to located the equipment thereon to a desired location or height above the ground. It is understood that assembly 100 is scalable both with the size, profile, and number of members used. This allows assembly 100 to be customized to any needs of the user and allows it to support heavy vertical loads and large moments imposed by natural forces (i.e. wind).

In FIG. 1, tilt over mast assembly 100 is shown only with base member 101 and mid member 103, as top member 125 is shown more clearly in FIG. 2. Assembly 100 may also include collars 105*a*-*b* and toggle collar 107. These are used to optionally facilitate securing mid member 103 to base member 101 and also optionally to allow pivoting of member 103 to that of member 101.

Any or all of members 101/103/125 are rigid in nature and can be formed from any materials deemed suitable. Exemplary materials may be that of carbon steel, composites, aluminum, or other customary material. For discussion it is assumed that the members are metal hollow structural sections.

Base member 101 has a first end (i.e., pole base 121) that is used to secure it to the ground 119. This may mean end 121 is submerged in ground 119 or that it may be coupled to a secured base adjacent the ground 119. Base member 101 includes a second end 123 (i.e., distal end 123) opposite that of end 121. As illustrated, end 123 is outside ground 119 and opposite that of end 121. The general alignment of base member 101 is vertical although it is conceived that situations may deem it desirable or necessary to orient base member 101 at some non perpendicular angle relative to ground 119.

Base member 101 has a set of cheek plates 111 located at a predetermined mid point between ends 121/123. The set of cheek plates are oriented on opposing planar faces of base member 101 such that the set of check plates combined with base member 101 serve to form a U-shaped channel. A portion of mid member 103 extends internally within or between cheek plates 111.

As noted previously, the cross-section profile of members 101/103/125 may be of any shape. It is worth noting that member 101 may have a channel section profile with three main sides. This would allow a portion of member 103 to fit internally within member 101 to create a more streamlined assembly profile and appearance. The necessity of or use of cheek plates 111 may be optional in a configuration where base member 101 is channeled.

Figure 4:
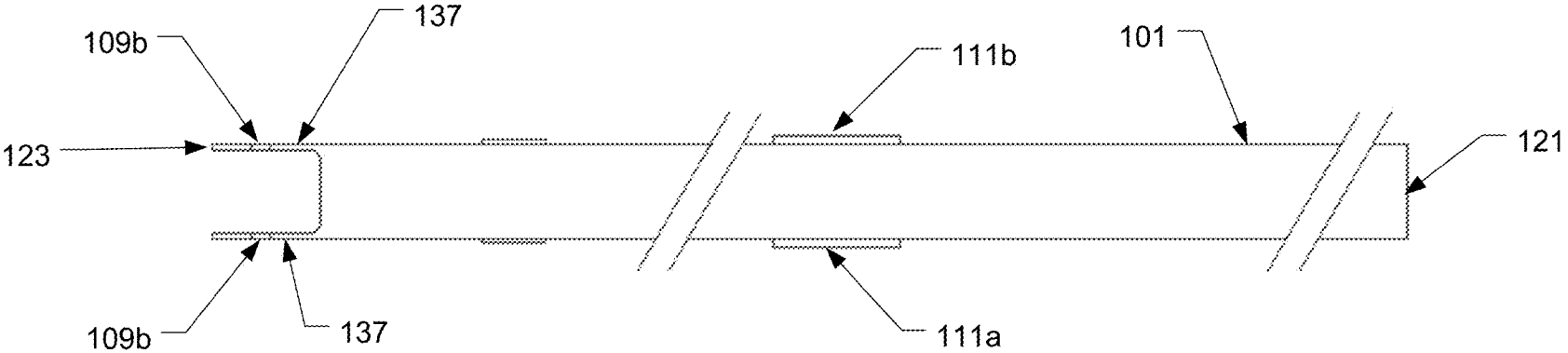
FIG. 4 is a front sectioned view of the base member of FIG. 1.

Base member 101 may also include a slotted profile at end 123 (see FIG. 4). This is used to seat toggle 108 formed onto toggle collar 107. Optionally, end 123 includes an aperture used to form a hinge point or axis (i.e., hinge 109). Toggle 108 and hinge 109 would be aligned to permit rotational movement about end 123. Toggle collar 107 is optionally permitted to rotate about end 123 and the depicted form is only one such embodiment to permit this to occur.

Mid member 103 is a hollowed metal pole having a first end 113 (i.e., pole base 113) and a second end 115 (i.e., distal end). First end 113 is coupled adjacent to or situated within cheek plates 111. Second end 115 is responsible for receiving and connecting a top member 125. A set screw aperture (aperture 117*c*) is located proximately from distal end 115 where a fastener (i.e. set screw) is used to fasten a top member to mid member 103.

Mid member 103 is coupled to/secured to base member 101 at plurality of locations. This provides stability to mid member 103. As noted above, cheek plates 111 may be used to secure first end 113. Toggle collar 107 is configured to surround a portion of mid member 103 at a determined location along its length between ends 113/115. Toggle 108 extends from toggle collar 107 to couple to a portion of base member 101. One manner in which toggle collar 107 is configured to receive mid member 103 is by concentrically sliding collars 105*a-b* and toggle collar 107 around mid member 103 and translating it along the length of mid member 103. The collars are configured such that toggle collar 107 is between collars 105*a-b*. Collars 105*a-b* are used to secure toggle collar 107 at a particular location on member 103. A fastener may be used to tighten the collars. Collars 105*a-b* are further depicted and described in reference to FIG. 8. Toggle collar 107 has toggle 108 that splays axially from collar 107. Toggle collar 107 is further depicted and described in reference to FIG. 7.

Referring now also to FIG. 2 in the drawings, tilt over mast assembly 100 is illustrated to show mid member 103 and top member 125 in accordance with an embodiment of the present invention. In FIG. 2, tilt over mast assembly 100 further depicts top member 125 connected with mid member 103. In this embodiment, top member 125 is a pole having a first end 127 (i.e., pole base 127) and a second end 129 (i.e., distal end 129). Pole base 127 of top member 125 is secured to mid member 103 adjacent end 129. On method to accomplish this is to concentrically insert top member 125 into the hollow body of mid member 103 whereby a fastener (i.e. set screw) conjoins mid member 103 with top member 125 via aperture 117*d*. In general, an antenna and/or a directional antenna is mountable to the body of top member 125 using a variety means appreciable to those knowledgeable in the art of antenna mounts. The length of top member 125 relative to member 103 may be adjusted.

Figure 3:
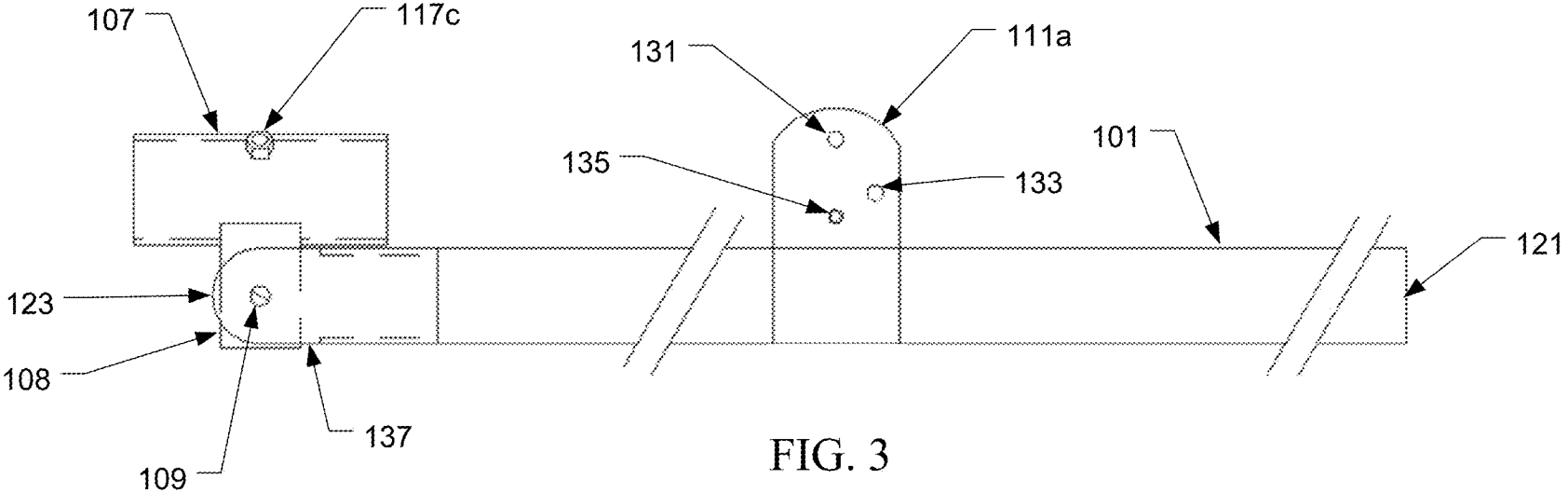
FIG. 3 is a sectioned side view of the base member of FIG. 1.

Referring now also to FIGS. 3 and 4 in the drawings, a side and front view of base member 101 are illustrated in accordance with an embodiment of the present invention. Cheek plates 111 are depicted in more clarity as comprising individual plates 111*a-b* with cheek plate 111*b* hidden from view in FIG. 3. Cheek plates 111 comprise a set of apertures configured to be used to selectively secure end 113 of mid member 103 to base member 101. The apertures may be as follows: aperture 131 located proximately from a distal end of cheek plate 111, aperture 133 located proximately from an edge closest towards pole base 121, and aperture 135 located proximately from a planar face of base member 101 that forms a U-shaped channel. Furthermore, aperture 135 is a threaded hole for receiving a fastener such as a set screw.

FIG. 3 also depicts toggle collar 107 in greater clarity. Toggle collar 107 is connected to base member 101. Whereas FIG. 4 depicts a top view with toggle collar 107 removed for clarity. Base member 101 has a set of hinge plate prongs 137 located at distal end 123 to form the slotted profile. The set of hinge plate prongs are on opposing planar faces of base member 101 extending outward from the main body at distal end 123. Each prong 137 has aperture 109*b*. Hinge 109 is formed by passing a bolt fastener concentrically through aperture 109*b* of prong 137 and aperture 109*a* of toggle 108 (see FIG. 7 for aperture 109*a*). In some embodiments, toggle collar 107 has set screw aperture 117*c* where a set screw conjoins mid member 103 to toggle collar 107.

Figure 5:
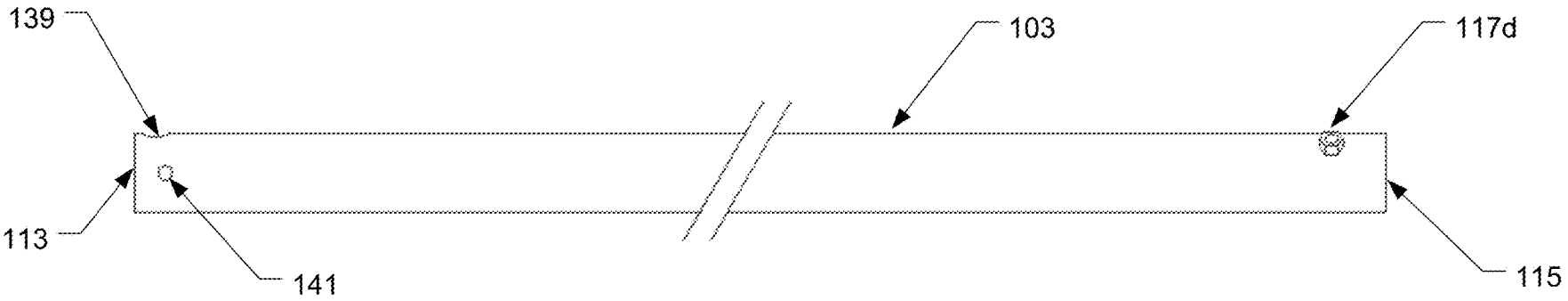
FIG. 5 is a side view of the mid member from FIG. 1.
Figure 6:
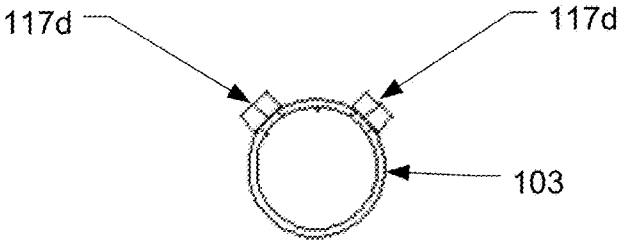
FIG. 6 is an axial view of the mid member of FIG. 5.

Referring now also to FIGS. 5 and 6 in the drawings, a side and axial view of mid member 103 is illustrated in accordance with an embodiment of the present invention.

In FIG. 5, mid member 103 has a set of apertures located proximately near a pole base 113. In this embodiment, apertures 141 is a through hole that passes through both sides of mid member 103, thus permitting a bolt to pass through mid member 103 via apertures 141. Aperture 139 is a hole located perpendicular with respect to apertures 141. Aperture 139 is a hole that permits a cable hook or clip associated with a lifting mechanism to connect to mid member 103. A portion of the lifting mechanism connects to aperture 139. Furthermore, mid member 103 has apertures 117*d* proximate to distal end 115. Apertures 117*d* are threaded holes that permit a set screw that conjoins mid member 103 with top member 125. As shown in FIG. 6, in some embodiments, apertures 117*d* are offset angularly at a predetermined angle.

Figure 7A:
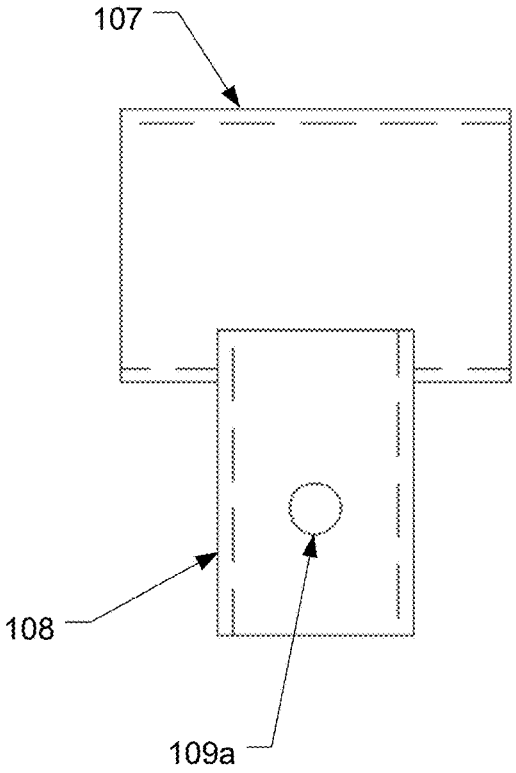
FIGS. 7A-7B are a front view and side view of a toggle collar in the tilt over mast assembly of FIG. 1.
Figure 7B:
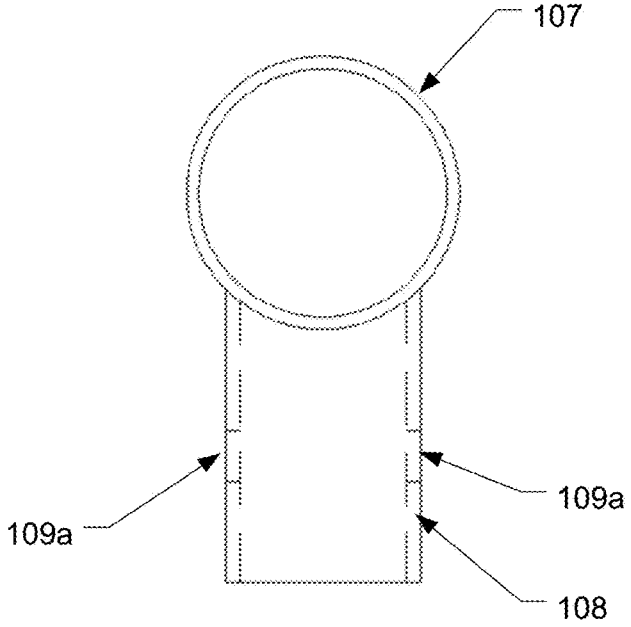

Referring now also to FIGS. 7A-7B in the drawings, views of toggle collar 107 are illustrated in accordance with an embodiment of the present invention. Toggle collar 107 is a hollowed body configured to permit mid member 103 to pass through it. In this embodiment, a toggle (i.e., toggle 108) extends perpendicularly from toggle collar 107. Toggle 108 has apertures 109*a* that permits a bolt fastener to pass unimpeded through both apertures 109*a*. In one embodiment, toggle 108 is configured to fit between prongs 137 such that apertures 109*a* of toggle 108 and apertures 109*b* are concentrically aligned, thus permitting hinge 109 to be formed by fastening a bolt through apertures 109-*b*. By forming hinge 109, toggle 108 (and subsequently toggle collar 107) can rotate with respect to base member 101. Prongs 137 and toggle 108 in conjunction with hinge 109 are configured to permit toggle 108 to rotate upwards of 180 degrees such that a mid member coupled to toggle collar 107 is capable of being parallel and adjacent to a first planar side of base member 101 and then rotatable by at least 180 degrees such that the mid member is parallel and adjacent to a second planar side of base member 101, wherein the first planar side is an opposing face of the second planar side.

Figure 8A:
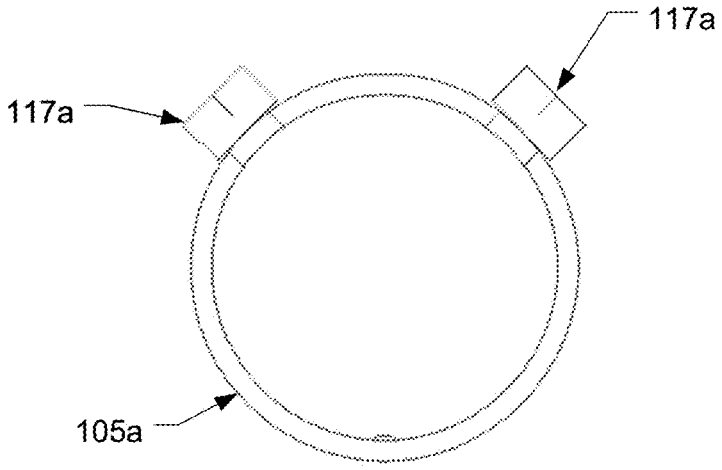
FIGS. 8A-8B are front and side views of a collar in the tilt over mast assembly of FIG. 1.
Figure 8B:
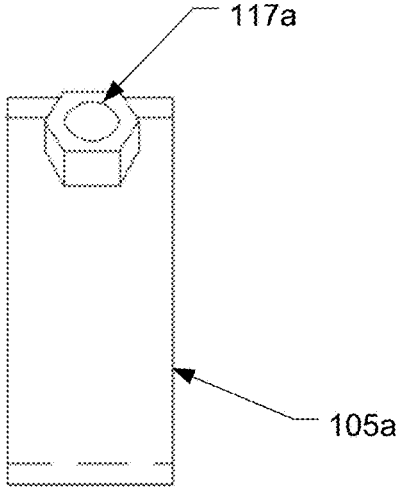

Referring now also to FIGS. 8A-8B in the drawings, views of collar 105*a* are illustrated in accordance with an embodiment of the present invention. Collar 105*a* is similar in form and function as collar 105*b* and the description of collar 105*a* will apply equally to that of collar 105*b*. Collar 105*a* is configured to permit mid member 103 to pass through it. Collar 105*a* has one or more apertures 117*a* wherein apertures 117*a* are threaded holes that permit a set screw that conjoins collar 105*a* with mid member 103. As shown in FIG. 8, in some embodiments, apertures 117*a* are offset angularly at a predetermined angle. In some embodiments, collar 105*a* may be cylindrical as shown but it is understood that other shapes are possible for mid member 103. Collar 105*a* may be formed having any internal volume shape sufficient to capture around mid member 103.

Figure 9:
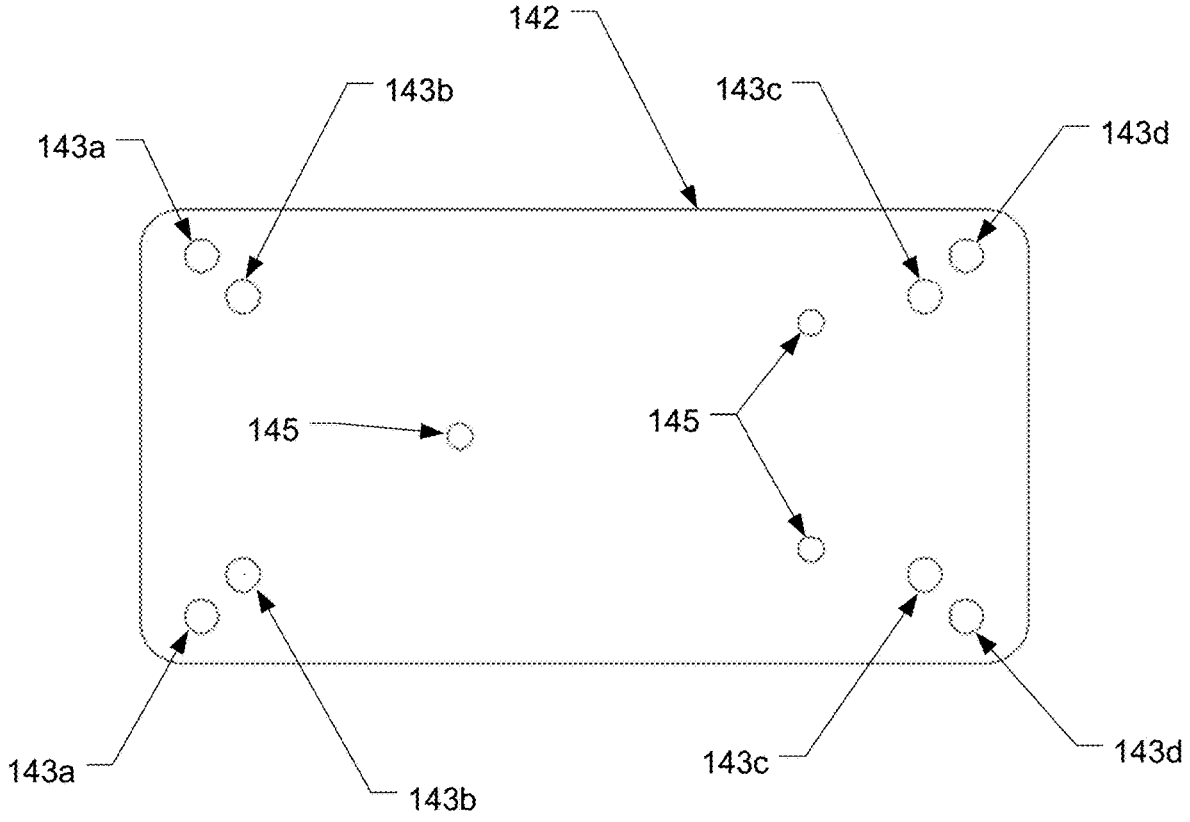
FIG. 9 is a front view of a lifting plate, in accordance with an embodiment of the present invention.

Referring now also to FIG. 9 in the drawings, a front view of a lifting plate 142 is illustrated. Lifting plate 142 is configured to have similar material properties for selection as that of members 101/103/125 noted above. Plate 142 has a variety of apertures for conjoining a lifting mechanism 147 with base member 101. In this figure, plate 142 has apertures 143*a-d* that permit a U-bolt to pass through plate 142 in order to conjoin plate 142 with base member 101. Apertures 143*a-d* are configured to different widths corresponding to different widths of base member 101. For example, apertures 143*a* and 143*d* are configured to a first width of base member 101, and apertures 143*b* and 143*c* are configured to a second width of base member 101. Plate 142 is attached to base member 101 by locating plate 142 planarly flush with a planar face of base member 101, passing a first U-bolt around the body of base member 101 and through apertures 143*a*, and fastening the first U-bolt using bolt nuts. In similar form and fashion in securing the first U-bolt, a second U-bolt corresponds to apertures 143*d*.

Furthermore, plate 142 has apertures 145 for mounting a lifting mechanism 147 (see FIG. 10). In some embodiments, apertures 145 is a through hole for permitting a bolt to pass through. In alternate embodiments, apertures 145 are threaded holes. Lifting mechanism 147 may be included with assembly 100 or may be procured separately.

Referring now also to FIGS. 10-12, different methods of using tilt over mast assembly 100 is illustrated. To construct tilt over mast assembly 100, users insert pole base 121 of base member 101 into ground 119, fasten lifting mechanism 147 to plate 142 via apertures 145 and fasteners 148. Plate 142 is fastened to a second planar side of base member 101 that opposes a first planar side of base member 101. The first planar side corresponds to a planar face that is most proximate to a U-shape channel formed between base member 101 and cheek plates 111. Users then slide collars 105*a-b* and toggle collar 107 around mid member 103 via pole base 113 such that the toggle collar 107 is positioned between collars 105*a* and 105*b*. These are located a distance between ends 113 and 115. These allow a portion of member 103 to pass within cheek plates 111. Once positioned, the users secure collars 105*a-b* to mid member 103 using set screws according to 117*a-b* such that collars 105*a-b* and toggle collar 107 are restricted from sliding along mid member 103.

In a first method of using assembly 100, the pivot location of member 103 may be selected to be at cheek plates 111. In this method, the users conjoin mid member 103 to cheek plates 111 using a fastener to create a temporary hinge and fulcrum for raising mid member 103. The users conjoin mid member 103 to cheek plates 111 according to apertures 131 of cheek plates 111 and apertures 141 of mid member 103. In an alternate embodiment, the users conjoin mid member 103 to cheek plates 111 according to apertures 133 and apertures 141 of mid member 103.

As seen in FIG. 10, a cylindrical wheel (i.e., pully 151) may be located in end 123 according to apertures 109*b* to serve as a pully for lifting mechanism 147. Cable 149 extends from lifting mechanism 147, around pulley 151, and connects cable 149 to a location 153 on mid member 103, wherein the location 153 is a position between distal end 115 of mid member 103 and the position corresponding to toggle collar 107. Operation of lifting mechanism 147 raises and lowers mid member 103 and top member 125 between a raised and lowered position. Upon connecting 149 to mid member 103, the user hoists member 103 vertically using lifting mechanism 147 such that mid member 103 pivots based on the temporary hinge formed by the bolt passing through apertures 141 and apertures of cheek plate 111. In this configuration, a user may elect to leave assembly 100 as constructed to maintain the pivot point about cheek plates 111 or may proceed further to adjust the pivot location to end 123 as noted below.

Once mid member 103 is raised vertically, the user optionally disconnects cable 149 from mid member 103, removes pully 151, inserts toggle 108 between prongs 137, and passes a bolt through apertures 109*a* of toggle 108 and apertures 109*b* of prongs 137 to form hinge 109. If necessary, the first user can adjust the position of toggle collar 107 by releasing set screws according to apertures 117*a-b*, sliding toggle collar 107 to an adjusted position that conforms to the alignment of toggle 108 and prongs 137. Once proper alignment is found, the first user resets the set screws of apertures 117*a-b*.

Once toggle 108 is aligned with prongs 137 and hinge 109 is formed, the second user removes the bolt that formed the temporary hinge between cheek plates 111 and mid member 103 via apertures 141. The resulting setup now conforms to assembly 100 in FIG. 1.

Referring now to FIG. 11. The second user then repositions lifting mechanism 147 and plate 142 to a location on the first planar side of base member 101 such that the location is between cheek plates 111 and ground 119, connects cable 149 to mid member 103 using end 113 and aperture 139, and, with assistance the user releases lifting mechanism 147 to rotate mid member 103 about hinge 109 such that end 113 is raised up towards distal end 123 and distal end 115 approaches ground 119.

The users then slide top member 125 into the body of mid member 103 via distal end 115 and conjoin top member 125 with mid member 103 by use of set screws according to apertures 117*d*. The resulting configuration is illustrated in FIG. 11. In some embodiments, the users attach an antenna or a directional antenna to top member 125.

The second user raises the conjoined mid member 103 and top member 125 into a vertical orientation by engaging winch 147, thereby rotating the conjoined mid member 103 and top member 125 about hinge 109 and bringing pole base 113 into the channel formed between cheek plates 111 and base member 101. The second user then passes a set of bolts through apertures 131 (without passing through apertures 141) of cheek plates 111, thereby restricting mid member 103 from rotating out of the channel formed by base member 101 and cheek plates 111. The user also inserts a bolt fastener according apertures 133 to prevent any unexpected sliding down towards ground 119 by mid member 103 should the set screws of collar 105*a-b* fail. The resulting configuration is illustrated in FIG. 12.

It should be noted that toggle collar 107 allows slewing of member 103. Collars 105*a* and 105*b* bind member 103 from moving axially but permit member 103 to rotate radially. Collar 105*b* bears the vertical load of the members 103 and above, ands acts as a plain bearing when slewing. In an alternative configuration, collars 105*a* and 105*b* are omitted, and apertures with fixing screws are installed in the collar 107, thus preventing axial movement of member 103. In this configuration, the fixing screws in collar 107 are loosened during slewing of member 103 and upper members. During slewing operations, the vertical, (axial) load of member 103 and upper members is borne at the cheek plates 111, by through bolt 133. Through-bolt 133 may be fitted with anti-friction radial bearings to reduce the slewing force required during azimuth adjustment. This is a suitable optional configuration that is simpler and less costly to that described above.

Lifting mechanism 147 may be mechanical in operation (i.e. mechanical crank) or include electrical components (i.e. winch). Additionally, hydraulics may be used with a pump system. Lifting mechanism is configured to facilitate the raising and lowering of mid member 103. This is done by tensioning a cable. Other embodiments may use a gear driven contraption with one or more motors.

It is understood that assembly 100 is suitable for a range of applications, including, by way of example, for area lighting, weather stations, beacons, signs, etc.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A tilt over mast assembly, comprising:

a singular base member having a first end and a second end, the base member secured to the ground at the first end;

a mid member pivotally coupled to the base member, the mid member having a first end and a second end, the mid member being secured to the base member below the second end of the singular base member;

a top member coupled to the second end of the mid member;

a plurality of cheek plates coupled to a portion of the base member, the mid member extending through an interior of the plurality of cheek plates external to the singular base member;

a lifting mechanism configured to facilitate the pivoting of the mid member relative to the base member;

wherein the mid member pivots about an axis defined within the cheek plates; and wherein the mid member is configured to pivot such that the top member is adjacent the ground to facilitate maintenance and adjustment, the mid member pivots relative to the base member between the ends of the base member.

2. The assembly of claim 1, wherein the lifting mechanism is coupled to the base member.

3. The assembly of claim 1, wherein the lifting mechanism is a winch.

4. The assembly of claim 1, wherein the lifting mechanism selectively applies tension on a cable to induce pivoting of the mid member.

5. The assembly of claim 1, further comprising:

a toggle collar coupled to the mid member, the toggle collar configured to secure the mid member to the second end of the base member.

6. The assembly of claim 5, wherein the toggle collar includes a toggle hingedly coupled to the second end of the base member.

7. The assembly of claim 5, wherein the toggle collar permits axial displacement and rotation of the mid member relative to the base member.

8. A tilt over mast assembly, comprising:

a singular base member having a first end and a second end, the base member secured to the ground at the first end, the base member including a plurality of cheek plates extending from opposing sides of the base member horizontally between the first end and the second end, the plurality of cheek plates forming a U-shaped channel with the base member;

a mid member pivotally coupled to the base member, the mid member having a first end and a second end, the mid member being secured to the base member at the plurality of cheek plates within the U-shaped channel;

a top member coupled to the second end of the mid member;

a lifting mechanism configured to facilitate the pivoting of the mid member relative to the base member, the lifting mechanism coupled to the base member; and a toggle collar coupled to the mid member, the toggle collar configured to secure the mid member to the second end of the base member;

wherein the mid member is configured to pivot relative to the base member about the first end of the mid member such that the top member is adjacent the ground to facilitate maintenance and adjustment.

9. The assembly of claim 8, wherein the toggle collar includes a toggle hingedly coupled to the second end of the base member.

10. The assembly of claim 8, wherein the lifting mechanism is coupled to the base member.

11. The assembly of claim 10, wherein the lifting mechanism is a winch.

12. The assembly of claim 10, wherein the lifting mechanism selectively applies tension on a cable to induce pivoting of the mid member.

* * * * *